US009772073B2

(12) United States Patent
Petluri et al.

(10) Patent No.: US 9,772,073 B2
(45) Date of Patent: Sep. 26, 2017

(54) ILLUMINATING WITH A MULTIZONE MIXING CUP

(71) Applicant: ECOSENSE LIGHTING INC, Los Angeles, CA (US)

(72) Inventors: Raghuram L. V. Petluri, Los Angeles, CA (US); Paul Kenneth Pickard, Los Angeles, CA (US); Robert Fletcher, Los Angeles, CA (US)

(73) Assignee: Ecosense Lighting Inc., Los Angeles, CA (US)

( * ) Notice: Subject to any disclaimer, the term of this patent is extended or adjusted under 35 U.S.C. 154(b) by 0 days.

(21) Appl. No.: 15/170,806

(22) Filed: Jun. 1, 2016

(65) Prior Publication Data

US 2017/0219170 A1 Aug. 3, 2017

Related U.S. Application Data

(63) Continuation of application No. PCT/US2016/015473, filed on Jan. 28, 2016.

(51) Int. Cl.

| | |
|---|---|
| ***F21V 9/00*** | (2015.01) |
| ***F21K 9/62*** | (2016.01) |
| ***F21V 9/16*** | (2006.01) |
| ***F21V 7/00*** | (2006.01) |
| ***F21V 3/04*** | (2006.01) |
| ***F21K 9/64*** | (2016.01) |
| *F21Y 115/10* | (2016.01) |
| *F21Y 113/13* | (2016.01) |

(52) U.S. Cl.

CPC ..... *F21K 9/62* (2016.08); *F21K 9/64* (2016.08); *F21V 3/04* (2013.01); *F21V 7/0083* (2013.01); *F21V 9/16* (2013.01); *F21Y 2113/13* (2016.08); *F21Y 2115/10* (2016.08)

(58) Field of Classification Search

CPC ..... F21K 9/62; F21K 9/64; F21V 9/16; F21V 7/0083; F21V 3/04; F21Y 2115/10

USPC ..... 362/231

See application file for complete search history.

(56) References Cited

U.S. PATENT DOCUMENTS

| | | | |
|---|---|---|---|
| 7,858,408 | B2 | 12/2010 | Mueller et al. |
| 8,058,088 | B2 | 11/2011 | Cannon et al. |
| 8,118,454 | B2 | 2/2012 | Rains, Jr. et al. |
| 8,256,930 | B2 | 9/2012 | Cheng et al. |
| 8,399,267 | B2 | 3/2013 | Ling |
| 8,449,128 | B2 | 5/2013 | Ko et al. |
| 8,556,469 | B2 | 10/2013 | Pickard |
| 8,602,579 | B2 | 12/2013 | Van de Ven et al. |

(Continued)

OTHER PUBLICATIONS

Koka et al., "Overcome major LED lighting design challenges with molded plastics" LED's Magazine, Mar. 23, 2015.

(Continued)

*Primary Examiner* — Laura Tso
*Assistant Examiner* — Naomi M Wolford
(74) *Attorney, Agent, or Firm* — Baker & Hostetler LLP

(57) ABSTRACT

An optical cup which mixes multiple channels of light to form a blended output, the device having discreet zones or channels including a plurality of reflective cavities each having a remote phosphor light converting appliance covering a cluster of LEDs providing a channel of light which is reflected upward. The predetermined blends of phosphors provide a predetermined range of illumination wavelengths in the output.

14 Claims, 9 Drawing Sheets

(56) References Cited

U.S. PATENT DOCUMENTS

| | | | | |
|---|---|---|---|---|
| 9,012,938 | B2 | 4/2015 | Yuan et al. | |
| 2009/0026913 | A1 | 1/2009 | Mrakovich | |
| 2010/0142189 | A1 | 6/2010 | Hong et al. | |
| 2011/0216522 | A1* | 9/2011 | Harbers | F21K 9/50 362/84 |
| 2012/0286304 | A1 | 11/2012 | Letoquin et al. | |
| 2013/0021775 | A1 | 1/2013 | Veerasamy et al. | |
| 2013/0207130 | A1 | 8/2013 | Reiherzer | |
| 2013/0235555 | A1 | 9/2013 | Tanaka | |
| 2014/0063779 | A1 | 3/2014 | Bradford | |
| 2014/0268631 | A1* | 9/2014 | Pickard | F21K 9/64 362/84 |
| 2014/0367633 | A1 | 12/2014 | Bibl et al. | |
| 2015/0162505 | A1* | 6/2015 | Jones | F21K 9/64 362/293 |
| 2015/0331285 | A1* | 11/2015 | Bibl | G02F 1/133603 362/84 |

OTHER PUBLICATIONS

International Search Report and Written Opinion dated Apr. 22, 2016, issued in International patent application PCT/US2016/015473 filed Jan. 28, 2016.

* cited by examiner

Ratio of spectral content in regions, highest spectral power wavelength region normalized to 100%.

| | 380-420 | 421-460 | 461-500 | 501-540 | 541-580 | 581-620 | 621-660 | 661-700 | 701-740 | 741-780 |
|---|---|---|---|---|---|---|---|---|---|---|
| Blue | 32.8 | 100.0 | 66.5 | 25.7 | 36.6 | 39.7 | 36.1 | 15.5 | 5.9 | 2.1 |
| Red | 3.9 | 6.9 | 3.2 | 7.9 | 14.0 | 55.0 | 100.0 | 61.8 | 25.1 | 7.7 |
| Yellow/Green | 1.0 | 1.9 | 5.9 | 67.8 | 100.0 | 95.0 | 85.2 | 48.1 | 18.3 | 5.6 |
| Cyan | 0.2 | 0.8 | 49.2 | 100.0 | 58.4 | 41.6 | 28.1 | 13.7 | 4.5 | 1.1 |

FIG. 8

ILLUMINATING WITH A MULTIZONE MIXING CUP

CROSS-REFERENCE TO RELATED APPLICATIONS

This patent application is a Continuation of international patent application PCT/US2016/015473 filed Jan. 28, 2016, the disclosures of which are incorporated by reference in its entirety.

FIELD

A method to blend and mix specific wavelength light emitting diode illumination.

BACKGROUND

A wide variety of light emitting devices are known in the art including, for example, incandescent light bulbs, fluorescent lights, and semiconductor light emitting devices such as light emitting diodes ("LEDs").

White light may be produced by utilizing one or more luminescent materials such as phosphors to convert some of the light emitted by one or more LEDs to light of one or more other colors. The combination of the light emitted by the LEDs that is not converted by the luminescent material(s) and the light of other colors that are emitted by the luminescent material(s) may produce a white or near-white light. White lighting from the aggregate emissions from multiple LED light sources, such as combinations of red, green, and blue LEDs, typically provide poor color rendering for general illumination applications due to the gaps in the spectral power distribution in regions remote from the peak wavelengths of the LEDs. Significant challenges remain in providing LED lamps that can provide white light across a range of CCT values while simultaneously achieving high efficiencies, high luminous flux, good color rendering, and acceptable color stability.

The luminescent materials such as phosphors, to be effective at absorbing light, must be in the path of the emitted light. Phosphors placed at the chip level will be in the path of substantially all of the emitted light, however they also are exposed to more heat than a remotely placed phosphor. Because phosphors are subject to thermal degradation, by separating the phosphor and the chip thermal degradation can be reduced. Separating the phosphor from the LED has been accomplished via the placement of the LED at one end of a reflective chamber and the placement of the phosphor at the other end. Traditional LED reflector combinations are very specific on distances and ratio of angle to LED and distance to remote phosphor or they will suffer from hot spots, thermal degradation, and uneven illumination. It is therefore a desideratum to provide an LED and reflector with remote photoluminescence materials that do not suffer from these drawbacks.

DISCLOSURE

Disclosed herein are aspects of methods and systems to blend multiple light channels to produce a preselected illumination spectrum by providing a common housing with an open top, openings at the bottom to cooperate with domed lumo converting appliances (DLCAs), each DLCA placed over an LED illumination source; altering the illumination produced by a first LED illumination source by passing it through a first domed lumo converting appliance (DLCA) associated with the common housing to produce a blue channel preselected spectral output; altering the illumination produced by a second LED illumination source by passing it through a second DLCA associated with the common housing to produce a red channel preselected spectral output; altering the illumination produced by a third LED illumination source by passing it through a third DLCA associated with the common housing to produce a yellow/green channel preselected spectral output; altering the illumination produced by a fourth LED illumination source by passing it through a fourth DLCA associated with the common housing to produce a cyan channel preselected spectral output; blending the blue, red, yellow/green, and cyan spectral outputs as they exit the common housing; and, wherein the first, second, and third LED illumination sources are blue LEDs and the fourth LED illumination is cyan LEDs. One or more of the LED illumination sources can be a cluster of LEDs.

Disclosed herein are aspects of methods and systems to blend multiple light channels to produce a preselected illumination spectrum by providing a common housing placed over a series of LED illumination sources; altering the illumination produced by a first LED illumination source by passing it through a first domed lumo converting appliance (DLCA) associated with the common housing to produce a blue channel preselected spectral output; altering the illumination produced by a second LED illumination source by passing it through a second DLCA associated with the common housing to produce a red channel preselected spectral output; altering the illumination produced by a third LED illumination source by passing it through a third DLCA associated with the common housing to produce a yellow/green channel preselected spectral output; altering the illumination produced by a fourth LED illumination source by passing it through a fourth DLCA associated with the common housing to produce a cyan channel preselected spectral output; blending the blue, red, yellow/green, and cyan spectral outputs as they exit the common housing; and, wherein the first, second, and third LED illumination sources are blue LEDs which have an output in the range of substantially 440-475 nms and the fourth LED illumination is a cyan LED which has an output in the range of substantially 490-515 nms. One or more of the LED illumination sources can be a cluster of LEDs.

In the above methods and systems each DLCA provides at least one of Phosphors A-F wherein phosphor blend "A" is Cerium doped lutetium aluminum garnet ($Lu_3Al_5O_{12}$) with an emission peak range of 530-540 nms; phosphor blend "B" is Cerium doped yttrium aluminum garnet ($Y_3Al_5O_{12}$) with an emission peak range of 545-555 nms; phosphor blend "C" is Cerium doped yttrium aluminum garnet ($Y_3Al_5O_{12}$) with an emission peak range of 645-655 nms; phosphor blend "D" is GBAM: $BaMgAl_{10}O_{17}$:Eu with an emission peak range of 520-530 nms; phosphor blend "E" is any semiconductor quantum dot material of appropriate size for an emission wavelength with a 620 nm peak and an emission peak of 625-635 nms; and, phosphor blend "F" is any semiconductor quantum dot material of appropriate size for an emission wavelength with a 610 nm peak and an emission peak of 605-615 nms.

In the above methods and systems the spectral output of the blue channel is substantially as shown in FIG. 4, with the horizontal scale being nanometers and the vertical scale being relative intensity. The spectral output of the red channel is substantially as shown in FIG. 5, with the horizontal scale being nanometers and the vertical scale being relative intensity. The spectral output of the yellow/ green channel is substantially as shown in FIG. 6, with the horizontal scale being nanometers and the vertical scale being relative intensity. The spectral output of the cyan channel is substantially as shown in FIG. 7, with the horizontal scale being nanometers and the vertical scale being relative intensity.

Disclosed herein are aspects of methods and systems to blend multiple light channels to produce a preselected illumination spectrum by providing a common housing with an open top, cavities each having open tops, openings at the bottom to fit over an LED illumination source with a lumo converting device over each cavity's open top; altering the illumination produced by a first LED illumination source by passing it through a first lumo converting appliance (LCA) to produce a blue channel preselected spectral output; altering the illumination produced by a second LED illumination source by passing it through a second LCA to produce a red channel preselected spectral output; altering the illumination produced by a third LED illumination source by passing it through a third LCA to produce a yellow/green channel preselected spectral output; altering the illumination produced by a fourth LED illumination source by passing it through a fourth LCA to produce a cyan channel preselected spectral output; blending the blue, red, yellow/green and cyan spectral outputs as they exit the common housing; and, wherein the first, second, and third LED illumination sources are blue LEDs and the fourth LED illumination is cyan LEDs. In some instances at least one of the LED illumination sources is a cluster of LEDs.

Disclosed herein are aspects of methods and systems to blend multiple light channels to produce a preselected illumination spectrum by providing a common housing with an open top, cavities each having open tops, openings at the bottom to fit over an LED illumination source with a lumo converting device over each cavity's open top; altering the illumination produced by a first LED illumination source by passing it through a first lumo converting appliance (LCA) to produce a blue channel preselected spectral output; altering the illumination produced by a second LED illumination source by passing it through a second LCA to produce a red channel preselected spectral output; altering the illumination produced by a third LED illumination source by passing it through a third LCA to produce a yellow/green channel preselected spectral output; altering the illumination produced by a fourth LED illumination source by passing it through a fourth LCA to produce a cyan channel preselected spectral output; blending the blue, red, yellow/green and cyan spectral outputs as they exit the common housing; and, wherein the first, second, and third LED illumination sources are blue LEDs which have an output in the range of substantially 440-475 nms and the fourth LED illumination is a cyan LED which has an output in the range of substantially 490-515 nms. In some instances at least one of the LED illumination sources is a cluster of LEDs.

In the above methods and systems each LCA provides at least one of Phosphors A-F wherein phosphor blend "A" is Cerium doped lutetium aluminum garnet ($Lu_3Al_5O_{12}$) with an emission peak range of 530-540 nms; phosphor blend "B" is Cerium doped yttrium aluminum garnet ($Y_3Al_5O_{12}$) with an emission peak range of 545-555 nms; phosphor blend "C" is Cerium doped yttrium aluminum garnet ($Y_3Al_5O_{12}$) with an emission peak range of 645-655 nms; phosphor blend "D" is GBAM: $BaMgAl_{10}O_{17}$:Eu with an emission peak range of 520-530 nms; phosphor blend "E" is any semiconductor quantum dot material of appropriate size for an emission wavelength with a 620 nm peak and an emission peak of 625-635 nms; and, phosphor blend "F" is any semiconductor quantum dot material of appropriate size for an emission wavelength with a 610 nm peak and an emission peak of 605-615 nms.

In the above methods and systems the spectral output of the blue channel is substantially as shown in FIG. 4, with the horizontal scale being nanometers and the vertical scale being relative intensity. The spectral output of the red channel is substantially as shown in FIG. 5, with the horizontal scale being nanometers and the vertical scale being relative intensity. The spectral output of the yellow/green channel is substantially as shown in FIG. 6, with the horizontal scale being nanometers and the vertical scale being relative intensity. The spectral output of the cyan channel is substantially as shown in FIG. 7, with the horizontal scale being nanometers and the vertical scale being relative intensity.

DRAWINGS

The disclosure, as well as the following further disclosure, is best understood when read in conjunction with the appended drawings. For the purpose of illustrating the disclosure, there are shown in the drawings exemplary implementations of the disclosure; however, the disclosure is not limited to the specific methods, compositions, and devices disclosed. In addition, the drawings are not necessarily drawn to scale. In the drawings:

FIG. 8 is a table of ratios of spectral content in regions, highest spectral power wavelength region normalized to 100%.

Figure 1A:
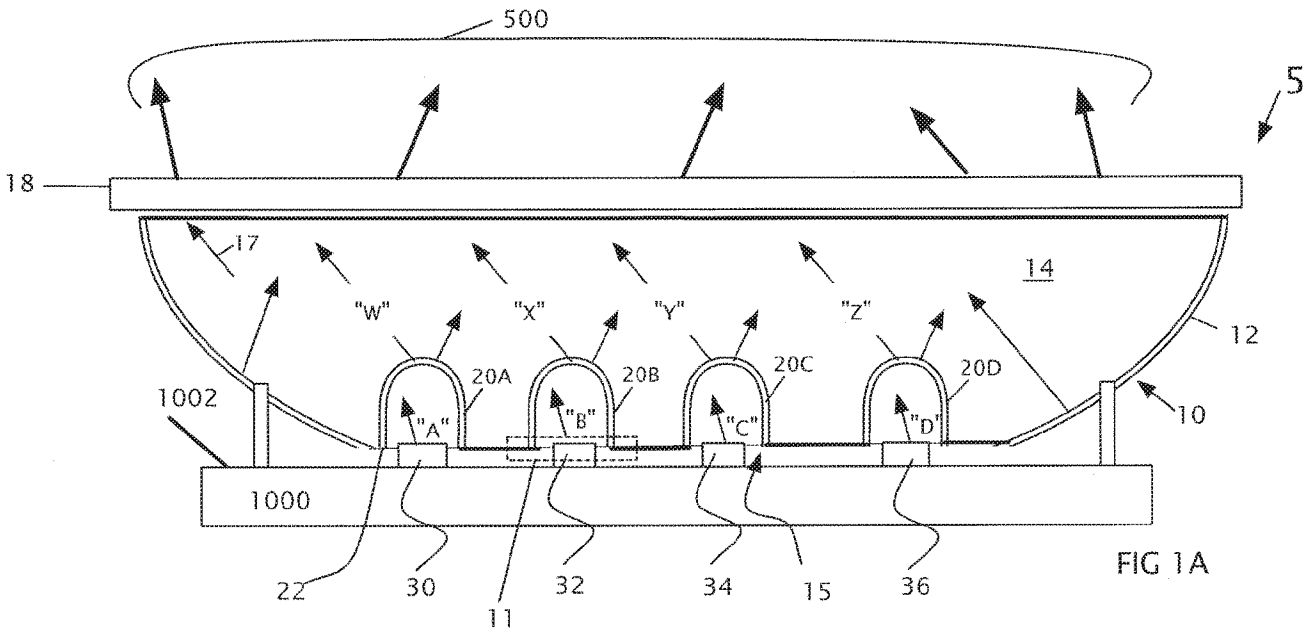
FIGS. 1A-1B illustrate a cut away side view and a top view of an optical cup with a common reflective body having a plurality of domed lumo converting appliances (DLCAs) over LEDs providing illumination.

The general disclosure and the following further disclosure are exemplary and explanatory only and are not restrictive of the disclosure, as defined in the appended claims. Other aspects of the present disclosure will be apparent to those skilled in the art in view of the details as provided herein. In the figures, like reference numerals designate corresponding parts throughout the different views. All callouts and annotations are hereby incorporated by this reference as if fully set forth herein.

FURTHER DISCLOSURE

Light emitting diode (LED) illumination has a plethora of advantages over incandescent to fluorescent illumination. Advantages include longevity, low energy consumption, and small size. White light is produced from a combination of LEDs utilizing phosphors to convert the wavelengths of light produced by the LED into a preselected wavelength or range of wavelengths. The light emitted by each light channel, i.e., the light emitted from the LED sources and associated lumo converting appliances (LCAs) or domed lumo converting appliances (DLCAs) together, can have a spectral power distribution ("SPD") having spectral power with ratios of power across the visible wavelength spectrum from about 380 nm to about 780 nm. While not wishing to be bound by any particular theory, it is speculated that the use of such LEDs in combination with recipient converting appliances to create unsaturated light within the suitable color channels provides for improved color rendering performance for white light across a predetermined range of CCTs from a single device. While not wishing to be bound by any particular theory, it is speculated that because the spectral power distributions for generated light within the blue, cyan, red, and yellow/green channels contain higher spectral intensity across visible wavelengths as compared to lighting apparatuses and methods that utilize more saturated colors, this allows for improved color rendering.

Lighting units disclosed herein have shared internal tops, a common interior annular wall, and a plurality of reflective cavities. The multiple cavities form a unified body and provide for close packing of the cavities to provide a small reflective unit to mate with a work piece having multiple LED sources or channels which provide wavelength specific light directed through one of lumo converting appliances (LCAs) and domed lumo converting appliances (DLCAs) and then blending the output as it exists the lighting units.

Figure 1B:
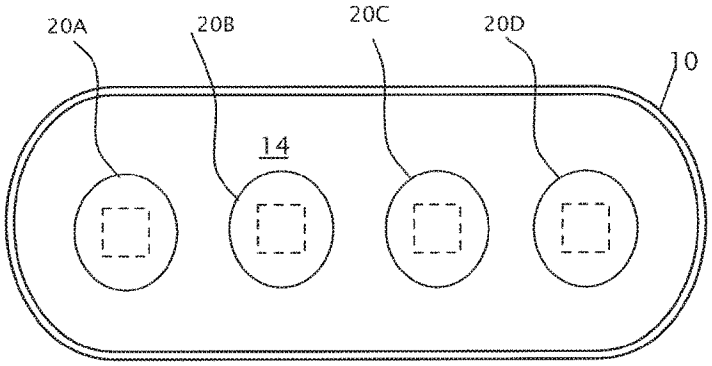

FIGS. 1A and 1B illustrate aspects of a reflective unit 5 on a work piece 1000 with a top surface 1002. The unit has a shared body 10 with an exterior wall 12, an interior wall 14, a series of open bottoms 15, and an open top 17. A plurality of DLCAs (20A-20D) are affixed to the reflective interior wall 14 at the open bottoms 15, and a diffuser 18 may be affixed to the open top 17.

Affixed to the surface 1002 of the work piece 1000 are light emitting diodes (LEDs). The first LED 30 emits a wavelength of light substantially "A", the second LED 32 emits a wavelength of light substantially "B", the third LED 34 emits a wavelength of light substantially "C" and the fourth LED 36 emits a wavelength of light substantially "D". In some instances wavelength "A" is substantially 440-475 nms, wavelength "B" is substantially 440-475 nms, wavelength "C" is substantially 440-475 nms, and wavelength "D" is substantially 490-515 nms.

When the reflective unit is placed over the LEDs on the work piece, DLCAs are aligned with each LED. An LED may also be a cluster of LEDs in close proximity to one another whereby they are located in the same open bottom. Aligned with the first LED is a first DLCA 20A; aligned with the second LED is a second DLCA 20B; aligned with the third LED is a third DLCA 20C; and, aligned with the fourth LED is a fourth DLCA 20D.

The DLCA is preferably mounted to the open bottom 15 of the cavity at an interface 11 wherein the open boundary rim 22 of the DLCA (20A-20D) is attached via adhesive, snap fit, friction fit, sonic weld or the like to the open bottoms 15. In some instances the DLCAs are detachable. The DLCA is a roughly hemispherical device with an open bottom, curved closed top, and thin walls. The DLCA locates photoluminescence material associated with the DLCA remote from the LED illumination sources.

The interior wall 14 may be constructed of a highly reflective material such as plastic and metals which may include coatings of highly reflective materials such as TiO2 (Titanium dioxide), Al2O3 (Aluminum oxide) or BaSO4 (Barium Sulfide) on Aluminum or other suitable material. Spectralan™, Teflon™, and PTFE (polytetrafluoethylene).

The emitted wavelengths of light from each of the LEDs or LED clusters are altered when they pass through the photoluminescence material which is associated with the DLCA. The photoluminescence material may be a coating on the DLCA or integrated within the material forming the DLCA.

The photoluminescence materials associated with LCAs 100 are used to select the wavelength of the light exiting the LCA. Photoluminescence materials include an inorganic or organic phosphor; silicate-based phosphors; aluminate-based phosphors; aluminate-silicate phosphors; nitride phosphors; sulfate phosphor; oxy-nitrides and oxy-sulfate phosphors; or garnet materials including luminescent materials such as those disclosed in co-pending application PCT/US2016/015318 filed Jan. 28, 2016, entitled "Compositions for LED Light Conversions," the entirety of which is hereby incorporated by this reference as if fully set forth herein. The phosphor materials are not limited to any specific examples and can include any phosphor material known in the art. Quantum dots are also known in the art. The color of light produced is from the quantum confinement effect associated with the nano-crystal structure of the quantum dots. The energy level of each quantum dot relates directly to the size of the quantum dot.

TABLE 1 shows aspects of some exemplar phosphor blends and properties.

| Designator | Material(s) | Density (g/mL) | Emission Peak (nm) | FWHM (nm) | Emission Peak Range (nm) | FWHM Range nm |
|---|---|---|---|---|---|---|
| Phosphor "A" | Luag: Cerium doped lutetium aluminum garnet ($Lu_3Al_5O_{12}$) | 6.73 | 535 | 95 | 530-540 | 90-100 |
| Phosphor "B" | Yag: Cerium doped yttrium aluminum garnet ($Y_3Al_5O_{12}$) | 4.7 | 550 | 110 | 545-555 | 105-115 |
| Phosphor "C" | a 650 nm-peak wavelength emission phosphor: Europium doped calcium aluminum silica nitride ($CaAlSiN_3$) | 3.1 | 650 | 90 | 645-655 | 85-95 |
| Phosphor "D" | a 525 nm-peak wavelength emission phosphor: GBAM:$BaMgAl_{10}O_{17}$:Eu | 3.1 | 525 | 60 | 520-530 | 55-65 |
| Phosphor "E" | a 630 nm-peak wavelength emission quantum dot: any semiconductor quantum dot material of appropriate size for desired emission wavelengths | 5.1 | 630 | 40 | 625-635 | 35-45 |

TABLE 1-continued shows aspects of some exemplar phosphor blends and properties.

| Designator | Material(s) | Density (g/mL) | Emission Peak (nm) | FWHM (nm) | Emission Peak Range (nm) | FWHM Range nm |
|---|---|---|---|---|---|---|
| Phosphor "F" | a 610 nm-peak wavelength emission quantum dot: any semiconductor quantum dot material of appropriate size for desired emission wavelengths | 5.1 | 610 | 40 | 605-615 | 35-45 |

Figure 4:
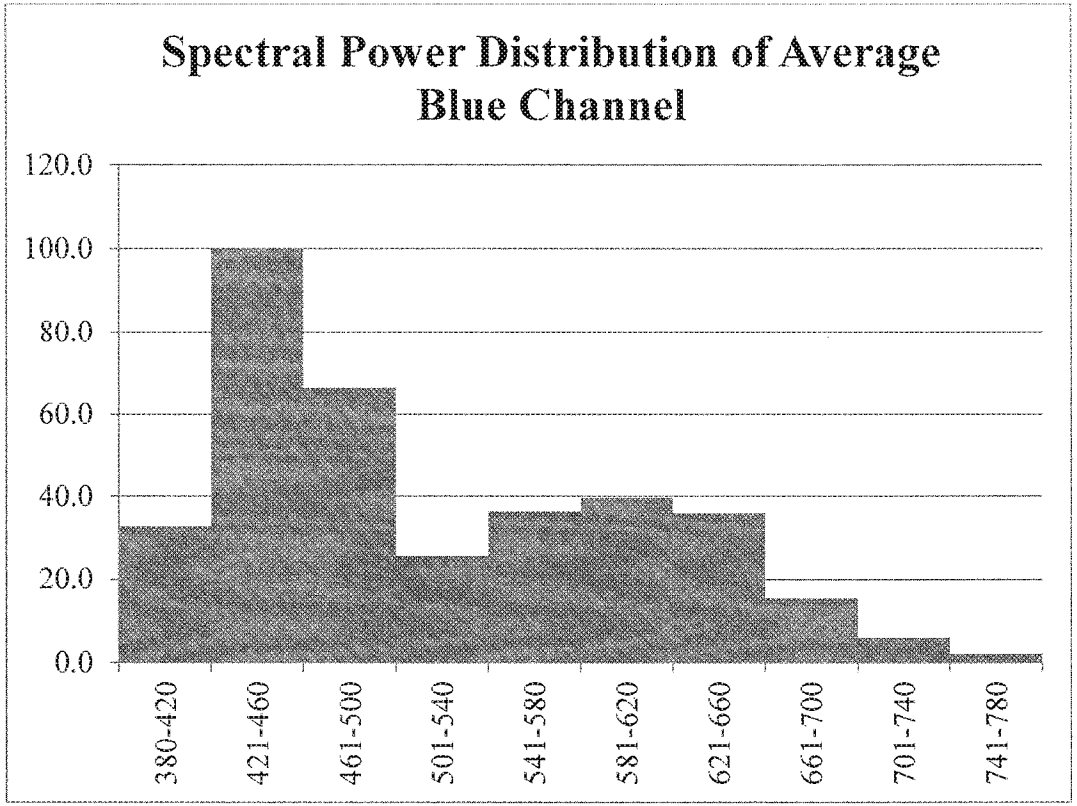
FIGS. 4-7 illustrate the spectral distribution from each of four channels providing illumination from optical cups disclosed herein.

The altered light "W" from the first DLCA (the "Blue Channel") 40A has a specific spectral pattern illustrated in FIG. 4. To achieve that spectral output a blend of the photoluminescence material, each with a peak emission spectrum, shown in table 1 are associated with the DLCA. Table 2 below shows nine variations of blends of phosphors A-F.

TABLE 2

Blue Channel blends

| Blends for Blue Channel | Phosphor "A" (excited by Blue LED) | Phosphor "B" (excited by Blue LED) | Phosphor "C" (excited by Blue LED) | Phosphor "D" (excited by Blue LED) | Phosphor "E" (excited by Blue LED) | Phosphor "F" (excited by Blue LED) |
|---|---|---|---|---|---|---|
| Blue Blend 1 | X | | X | | | |
| Blue Blend 2 | | X | X | | | |
| Blue Blend 3 | X | X | X | | | |
| Blue Blend 4 | | | X | X | | |
| Blue Blend 5 | | X | X | X | | |
| Blue Blend 6 | X | | | | X | |
| Blue Blend 7 | X | | | | X | X |
| Blue Blend 8 | | X | | | X | |
| Blue Blend 9 | | X | | | X | X |

Figure 5:
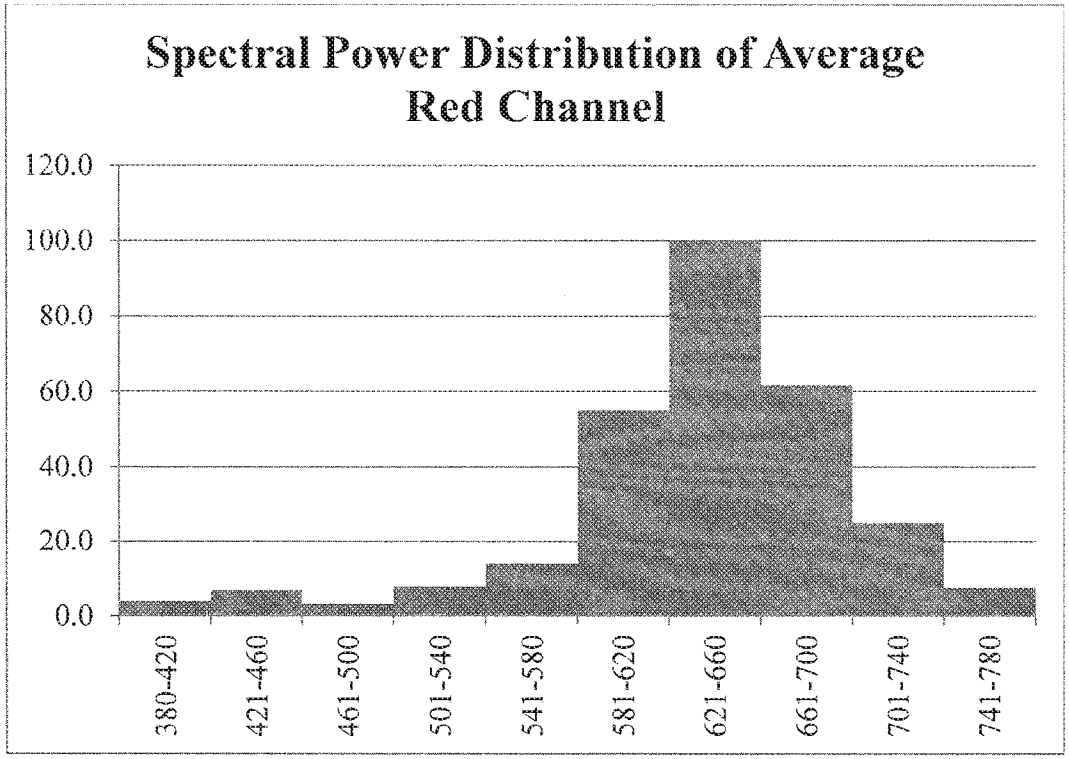

The altered light "X" from the second DLCA (the "Red Channel") 40B has a specific spectral pattern illustrated in FIG. 5. To achieve that spectral output a blend of the photoluminescence material, each with a peak emission spectrum, shown in table 1 are associated with the DLCA. Table 3 below shows nine variations of blends of phosphors A-F.

TABLE 3

Red Channel blends

| Blends for Red Channel | Phosphor "A" (excited by Blue LED) | Phosphor "B" (excited by Blue LED) | Phosphor "C" (excited by Blue LED) | Phosphor "D" (excited by Blue LED) | Phosphor "E" (excited by Blue LED) | Phosphor "F" (excited by Blue LED) |
|---|---|---|---|---|---|---|
| RED Blend 1 | | | X | | | |
| RED Blend 2 | X | | X | | | |
| RED Blend 3 | | X | X | | | |
| RED Blend 4 | X | X | X | | | |
| RED Blend 5 | | | X | X | | |
| RED Blend 6 | | X | X | X | | |
| RED Blend 7 | | | | | X | X |
| RED Blend 8 | X | | | | X | X |
| RED Blend 9 | | X | | | X | X |

Figure 6:
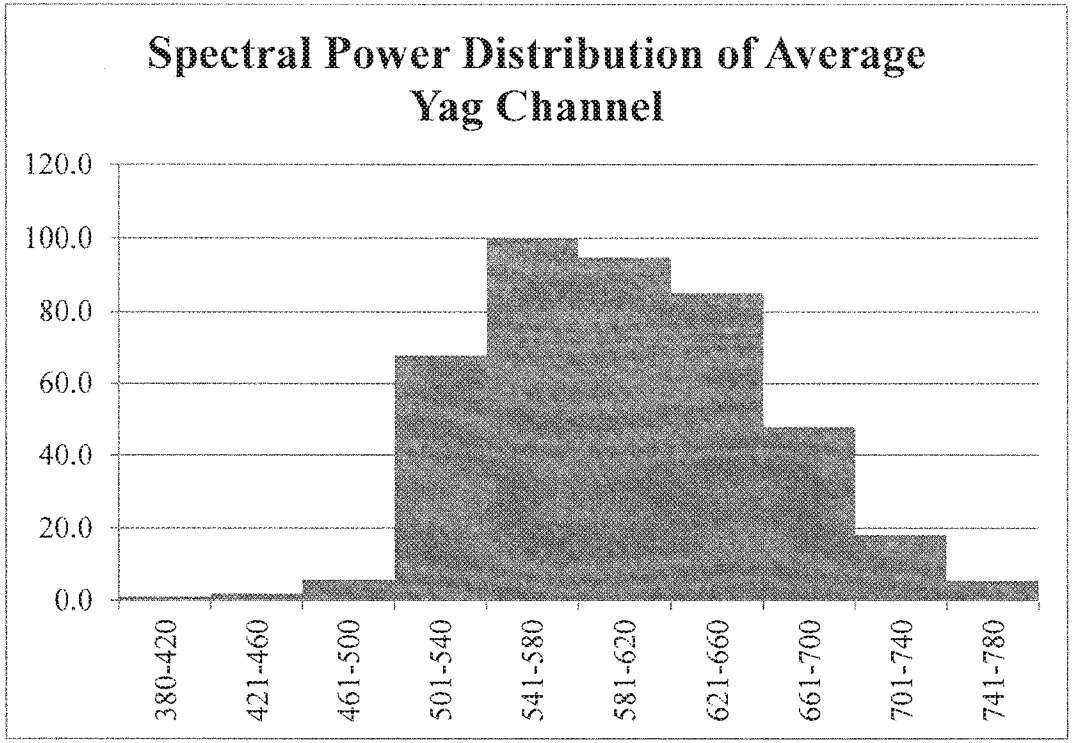

The altered light "Y" from the third DLCA (the "Yellow/Green Channel") 40C has a specific spectral pattern illustrated in FIG. 6. To achieve that spectral output a blend of the photoluminescence materials, each with a peak emission spectrum, shown in table 1 are associated with the DLCA. Table 4 below shows ten variations of blends of phosphors A-F.

TABLE 4

| Yellow/Green Channel | | | | | | |
|---|---|---|---|---|---|---|
| Blends for Yellow/Green (Y/G) Channel | Phosphor "A" (excited by Blue LED) | Phosphor "B" (excited by Blue LED) | Phosphor "C" (excited by Blue LED) | Phosphor "D" (excited by Blue LED) | Phosphor "E" (excited by Blue LED) | Phosphor "F" (excited by Blue LED) |
| Y/G Blend 1 | X | | | | | |
| Y/G Blend 2 | X | X | | | | |
| Y/G Blend 3 | X | | X | | | |
| Y/G Blend 4 | | X | X | | | |
| Y/G Blend 5 | X | X | X | | | |
| Y/G Blend 6 | | | X | X | | |
| Y/G Blend 7 | | X | X | X | | |
| Y/G Blend 8 | X | | | | X | |
| Y/G Blend 9 | X | | | | X | X |
| Y/G Blend 10 | | X | | | X | X |

Figure 7:
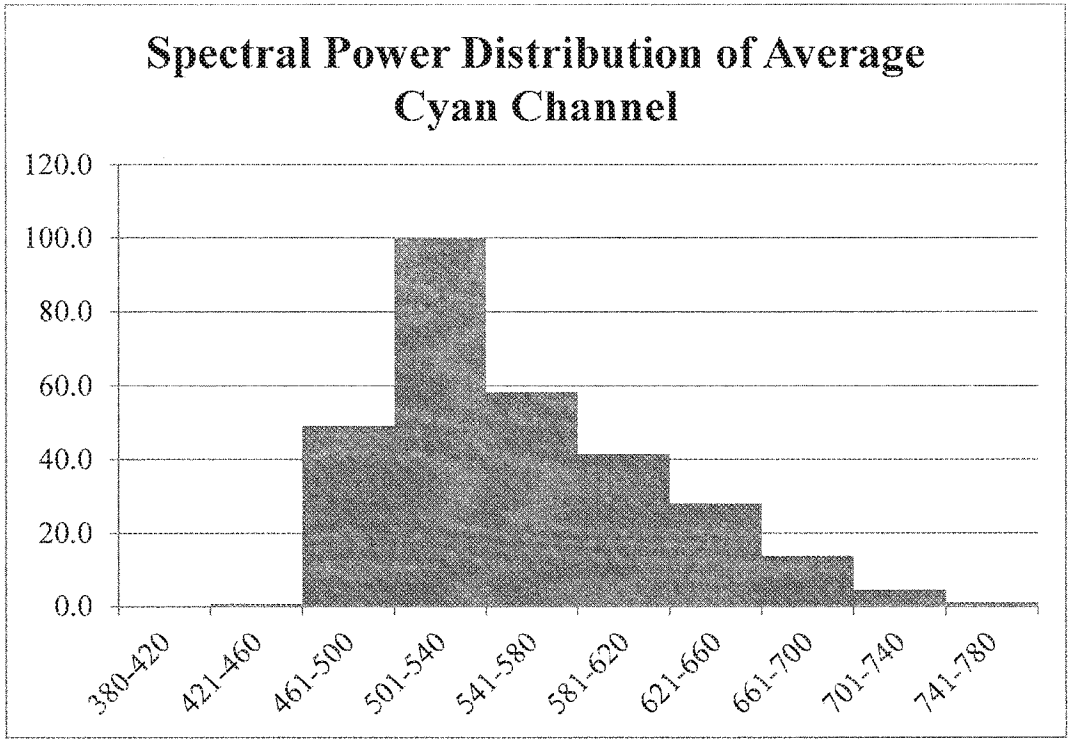

The altered light "Z" from the fourth DLCA (the "Cyan Channel") 40D has a specific spectral pattern illustrated in FIG. 7. To achieve that spectral output a blend of the photoluminescence materials, each with a peak emission spectrum, shown in table 1 are associated with the DLCA. Table 4 below shows nine variations of blends of phosphors A-F.

TABLE 5

| Cyan Channel. | | | | | | |
|---|---|---|---|---|---|---|
| Blends for Cyan Channel | Phosphor "A" (excited by Cyan LED) | Phosphor "B" (excited by Cyan LED) | Phosphor "C" (excited by Cyan LED) | Phosphor "D" (excited by Cyan LED) | Phosphor "E" (excited by Cyan LED) | Phosphor "F" (excited by Cyan LED) |
| CYAN Blend 1 | | | X | | | |
| CYAN Blend 2 | X | | X | | | |
| CYAN Blend 3 | | X | X | | | |
| CYAN Blend 4 | X | X | X | | | |
| CYAN Blend 5 | | | X | X | | |
| CYAN Blend 6 | | X | X | X | | |
| CYAN Blend 7 | X | | | | X | |
| CYAN Blend 8 | X | | | | X | X |
| CYAN Blend 9 | | X | | | X | X |

The photoluminescence material may be a coating on the DLCA or integrated within the material forming the DLCA.

Light mixes in unit, may reflect off internal wall 14 and exits top 17 which may include diffuser 18. The diffuser may be glass or plastic and may also be coated or embedded with Phosphors. The diffuser functions to diffuse at least a portion of the illumination exiting the unit to improve uniformity of the illumination from the unit.

The altered light wavelengths "X"-"Z" are preselected to blend to produce substantially white light 500.

In some instances wavelengths "W" have the spectral power distribution shown in FIG. 5 with a peak in the 421-460 nms range; wavelengths "X" have the spectral power distribution shown in FIG. 6 with a peak in the 621-660 nms range; wavelength "Y" have the spectral power distribution shown in FIG. 7 with peaks in the 501-660 nms range; and, wavelength "Z" have the spectral power distribution shown in FIG. 8 with peaks in the 501-540 nms range.

The process and method of producing white light 500 includes mixing or blending altered light wavelengths "W"-"Z" within the shared body 10. The mixing takes place as the illumination from each DLCA is reflected off the interior wall 14 of the shared body 10. Additional blending and smoothing takes place as the light passes through the optional diffuser 18.

FIG. 8 shows an average for minimum and maximum ranges of the spectral distributions in a given range of wavelengths 40 nm segments for each color channel.

Figure 2:
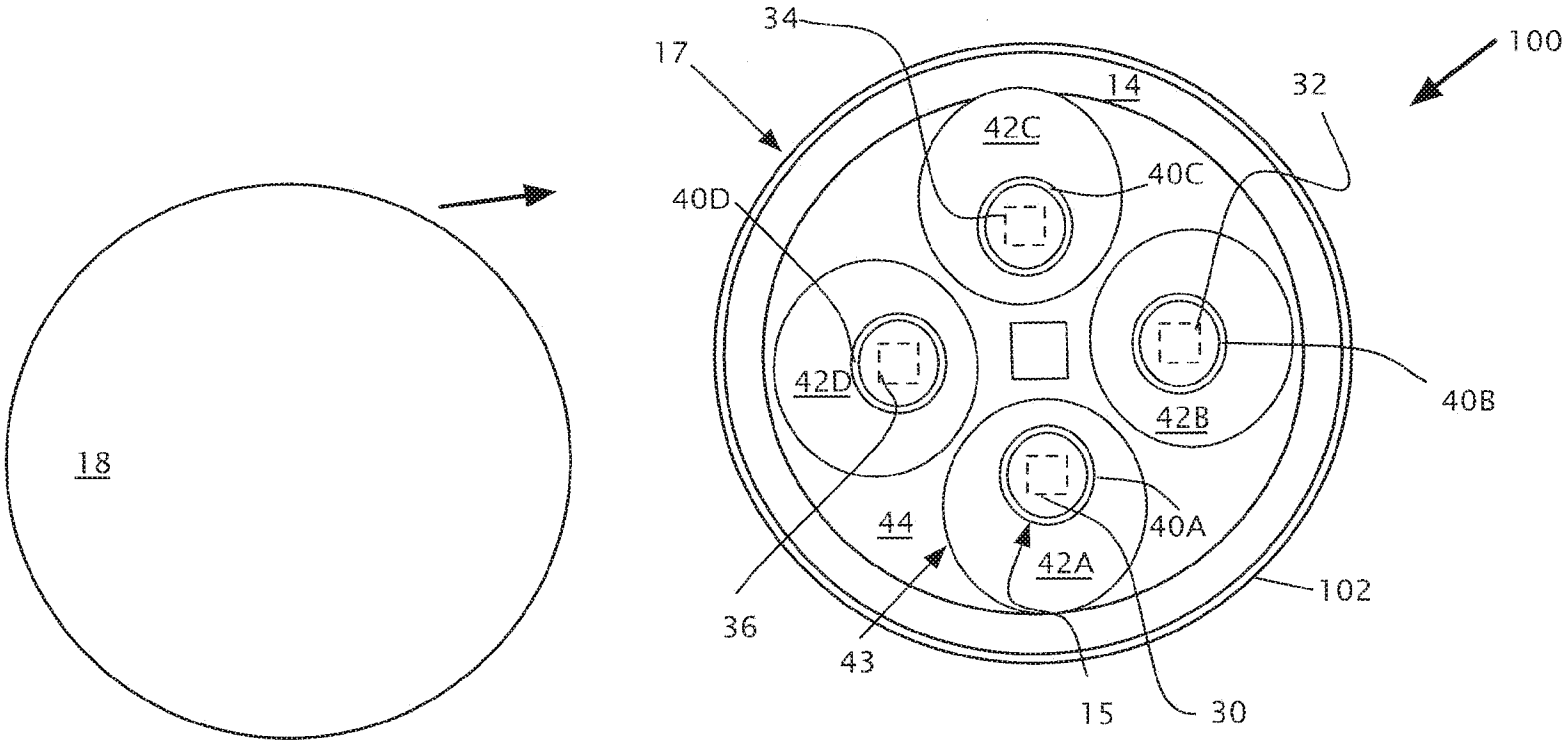
FIG. 2 illustrates a top view of a multiple zoned optical cup (ZOC) with DLCA within cavities.

FIG. 2 illustrates aspects of a shared body having separate reflective cavities, each cavity containing a DLCA.

FIG. 2 illustrates aspects of a reflective unit 100. The unit has a shared body 102 with an exterior wall 12, an interior wall 14, a plurality of cavities 42A-42D each with an open bottom 15, and a shared open top 17. A plurality of DLCAs (40A-40D) are affixed to the interior wall 12 at the open bottoms 15, and a diffuser 18 may be affixed to the open top 17.

Affixed to the surface of a work piece are light emitting diodes (LEDs). The first LED 30 emits a wavelength of light substantially "A", the second LED 32 emits a wavelength of light substantially "B", the third LED 34 emits a wavelength of light substantially "C" and the fourth LED 36 emits a wavelength of light substantially "D". In some instances wavelength "A" is substantially 440-475 nms, wavelength "B" is 440-475 nms, wavelength "C" is 440-475 nms, and wavelength "D" is 490-515 nms.

When the reflective unit 100 is placed over the LEDs on the work piece, DLCAs in each cavity are aligned with each LED. An LED may also be a cluster of LEDs in close proximity to one another whereby they are located in the same open bottom. Aligned with the first LED is a first DLCA 40A; aligned with the second LED is a second DLCA 40B; aligned with the third LED is a third DLCA 40C; and, aligned with the fourth LED is a fourth DLCA 40D.

The emitted wavelengths of light from each of the LEDs or LED clusters are altered when they pass through the photoluminescence material which is associated with the DLCA. The photoluminescence material may be a coating on the DLCA or integrated within the material forming the DLCA.

The photoluminescence materials associated with DLCAs are used to select the wavelength of the light exiting the DLCA. Photoluminescence materials include an inorganic or organic phosphor; silicate-based phosphors; aluminate-based phosphors; aluminate-silicate phosphors; nitride phosphors; sulfate phosphor; oxy-nitrides and oxy-sulfate phosphors; or garnet materials. The phosphor materials are not limited to any specific examples and can include any phosphor material known in the art. Quantum dots are also known in the art. The color of light produced is from the quantum confinement effect associated with the nano-crystal structure of the quantum dots. The energy level of each quantum dot relates directly to the size of the quantum dot.

The illustration of four cavities is not a limitation; those of ordinary skill in the art will recognize that a two, three, four, five or more reflective cavity device is within the scope of this disclosure. Moreover, those of ordinary skill in the art will recognize that the specific size and shape of the reflective cavities in the unitary body may be predetermined to be different volumes and shapes; uniformity of reflective cavities for a unitary unit is not a limitation of this disclosure.

The altered light "W" from the first DLCA (the "Blue Channel") 40A has a specific spectral pattern illustrated in FIG. 4. To achieve that spectral output a blend of the photoluminescence material, each with a peak emission spectrum, shown in table 1 are associated with the DLCA. Table 2 above shows nine variations of blends of phosphors A-F.

The altered light "X" from the second DLCA (the "Red Channel") 40B has a specific spectral pattern illustrated in FIG. 5. To achieve that spectral output a blend of the photoluminescence material, each with a peak emission spectrum, shown in table 1 are associated with the DLCA. Table 3 above shows nine variations of blends of phosphors A-F The altered light "Y" from the third DLCA (the "Yellow/Green Channel") 40C has a specific spectral pattern illustrated in FIG. 6. To achieve that spectral output a blend of the photoluminescence materials, each with a peak emission spectrum, shown in table 1 are associated with the DLCA. Table 4 above shows ten variations of blends of phosphors A-F.

The altered light "Z" from the fourth DLCA (the "Cyan Channel") 40D has a specific spectral pattern illustrated in FIG. 7. To achieve that spectral output a blend of the photoluminescence materials, each with a peak emission spectrum, shown in table 1 are associated with the DLCA. Table 4 above shows nine variations of blends of phosphors A-F.

The photoluminescence material may be a coating on the DLCA or integrated within the material forming the DLCA.

Light mixes in unit, may reflect off internal wall 14 and exits top 17 which may include diffuser 18. The altered light wavelengths "X"-"Z" are preselected to blend to produce substantially white light.

In some instances wavelengths "W" have the spectral power distribution shown in FIG. 4 with a peak in the 421-460 nms range; wavelengths "X" have the spectral power distribution shown in FIG. 5 with a peak in the 621-660 nms range; wavelength "Y" have the spectral power distribution shown in FIG. 6 with peaks in the 501-660 nms range; and, wavelength "Z" have the spectral power distribution shown in FIG. 7 with peaks in the 501-540 nms range.

The process and method of producing white light 500 includes mixing or blending altered light wavelengths "W"-"Z" within the shared body 10. The mixing takes place as the illumination from each DLCA is reflected off the interior wall 14 of the shared body 10. A common reflective top surface 44, which sits above the open tops 43 of each cavity, may be added to provide additional reflection and direction for the wavelengths. Additional blending and smoothing takes place as the light passes through the optional diffuser 18.

Figure 3A:
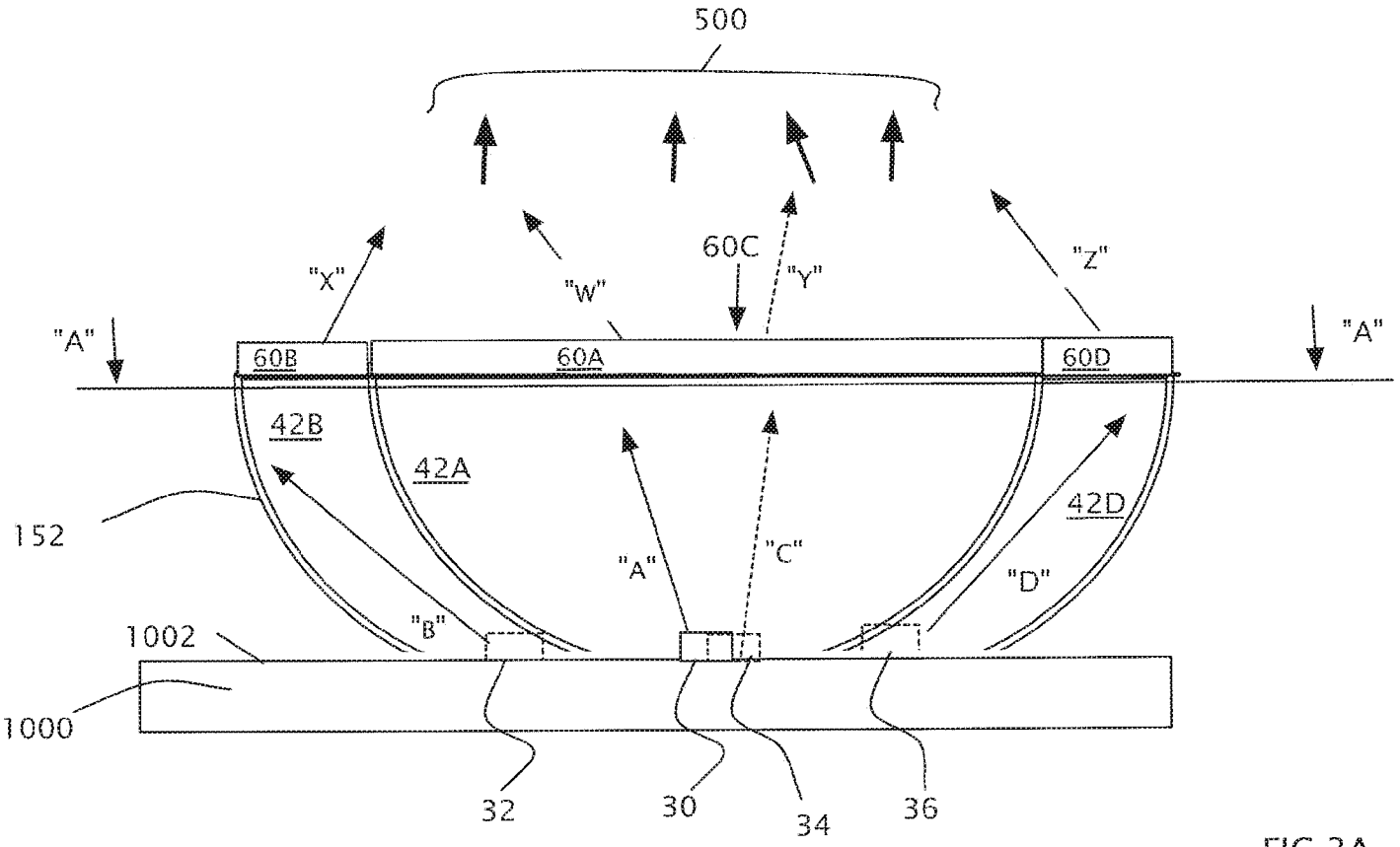
FIGS. 3A and 3B illustrate a zoned optical cup (ZOC) with lumo converting appliances (LCAs) above reflective cavities and the illumination therefrom.
Figure 3B:
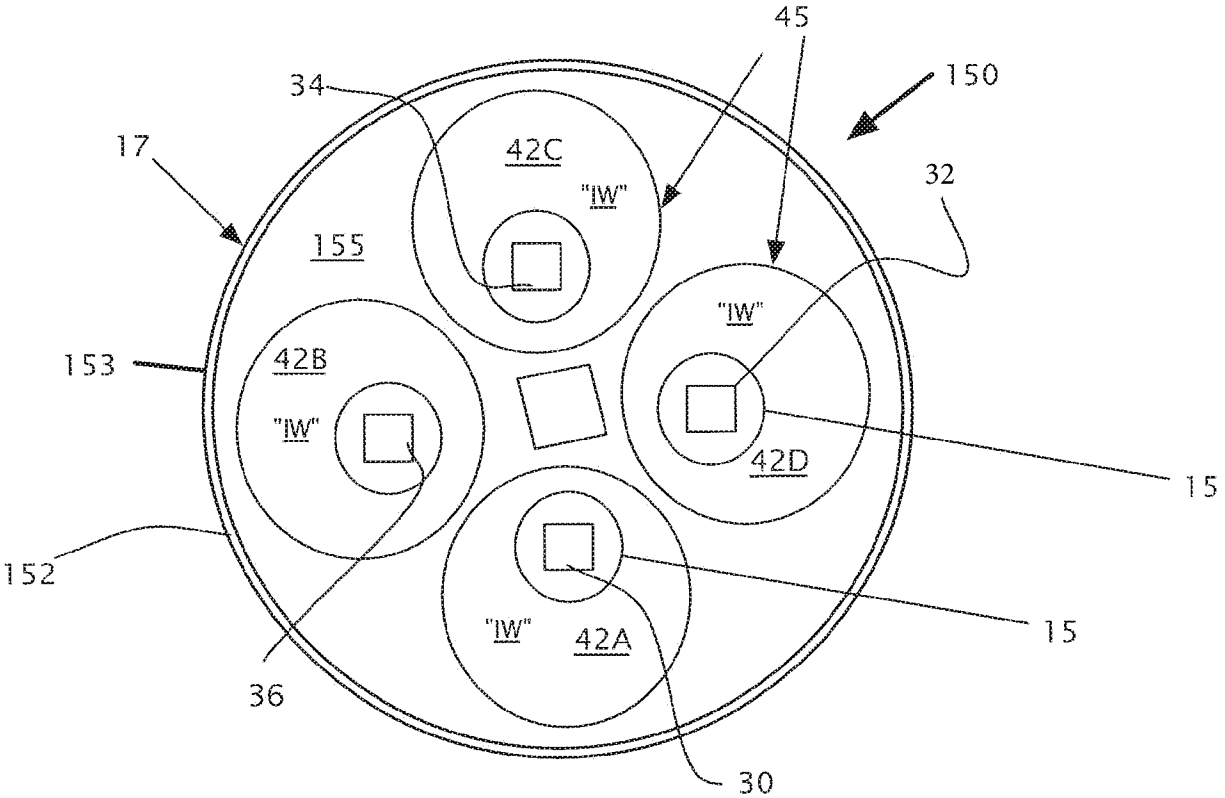

FIGS. 3A and 3B illustrate aspects of a reflective unit 150. The unit has a shared body 152 with an exterior wall 153, and a plurality of reflective cavities 42A-42D. Each reflective cavity has an open bottom 15, and an open top 45. A plurality of LCAs (60A-60D) are affixed to the open tops 45. The multiple cavities form a unified body 152 and provide for close packing of the cavities to provide a small reflective unit. The LCAs 60A-60D can be formed as substantially planar circular disks as illustrated in FIGS. 3A and 3B.

Affixed to the surface 1002 of a work piece 1000 are light emitting diodes (LEDs). The first LED 30 emits a wavelength of light substantially "A", the second LED 32 emits a wavelength of light substantially "B", the third LED 34 emits a wavelength of light substantially "C" and the fourth LED 36 emits a wavelength of light substantially "D". In some instances wavelength "A" is substantially 440-475 nms, wavelength "B" is 440-475 nms, wavelength "C" is 440-475 nms, and wavelength "D" is 490-515 nms.

When the reflective unit 150 is placed over the LEDs each cavity is aligned with an LED. An LED may also be a cluster of LEDs in close proximity to one another whereby they are located in the same open bottom.

Each reflective cavity has an open top 45. The reflective cavities direct the light from each LED towards the open top 45. Affixed to the open top of each cavity is a lumo converting device (LCA) 60A-60D. These are the first through fourth LCAs.

The emitted wavelengths of light from each of the LEDs or LED clusters are altered when they pass through the photoluminescence material which is associated with the LCA. The photoluminescence material may be a coating on the LCA or integrated within the material forming the LCA.

The photoluminescence materials associated with LCAs are used to select the wavelength of the light exiting the LCA. Photoluminescence materials include an inorganic or organic phosphor; silicate-based phosphors; aluminate-based phosphors; aluminate-silicate phosphors; nitride phosphors; sulfate phosphor; oxy-nitrides and oxy-sulfate phosphors; or garnet materials. The phosphor materials are not limited to any specific examples and can include any phosphor material known in the art. Quantum dots are also known in the art. The color of light produced is from the quantum confinement effect associated with the nano-crystal structure of the quantum dots. The energy level of each quantum dot relates directly to the size of the quantum dot.

The altered light "W" from the first LCA (the "Blue Channel") 60A has a specific spectral pattern illustrated in FIG. 4. To achieve that spectral output a blend of the photoluminescence material, each with a peak emission spectrum, shown in table 1 are associated with the LCA. Table 2 above shows nine variations of blends of phosphors A-F.

The altered light "X" from the second LCA (the "Red Channel") 60B has a specific spectral pattern illustrated in FIG. 5. To achieve that spectral output a blend of the photoluminescence material, each with a peak emission spectrum, shown in table 1 are associated with the LCA. Table 3 above shows nine variations of blends of phosphors A-F.

The altered light "Y" from the third LCA (the "Yellow/Green Channel") 60C has a specific spectral pattern illustrated in FIG. 6. To achieve that spectral output a blend of the photoluminescence materials, each with a peak emission spectrum, shown in table 1 are associated with the LCA. Table 4 above shows ten variations of blends of phosphors A-F.

The altered light "Z" from the fourth LCA (the "Cyan Channel") 60D has a specific spectral pattern illustrated in FIG. 7. To achieve that spectral output a blend of the photoluminescence materials, each with a peak emission spectrum, shown in table 1 are associated with the LCA. Table 4 above shows nine variations of blends of phosphors A-F.

Photoluminescence material may also be a coating on the reflective cavity internal wall "IW". A reflective surface 155 is provided on the interior surface of the exterior wall 153 as shown in the top cut-away view in FIG. 3B.

Light mixes in unit, may reflect off internal wall 14 and exits top 17 which may include diffuser 18. The altered light wavelengths "X"-"Z" are preselected to blend to produce substantially white light.

In some instances wavelengths "W" have the spectral power distribution shown in FIG. 4 with a peak in the 421-460 nms range; wavelengths "X" have the spectral power distribution shown in FIG. 5 with a peak in the 621-660 nms range; wavelengths "Y" have the spectral power distribution shown in FIG. 6 with peaks in the 501-660 nms range; and, wavelengths "Z" have the spectral power distribution shown in FIG. 7 with peaks in the 501-540 nms range.

The process and method of producing white light 500 includes mixing or blending altered light wavelengths "W"-"Z" as the light leaves the reflective unit 150. The mixing takes place as the illumination from each cavity passes through each LCA and then blends as the wavelengths move forward.

It will be understood that various aspects or details of the invention(s) may be changed without departing from the scope of the disclosure and invention. It is not exhaustive and does not limit the claimed inventions to the precise form disclosed. Furthermore, the foregoing description is for the purpose of illustration only, and not for the purpose of limitation. Modifications and variations are possible in light of the above description or may be acquired from practicing the invention. The claims and their equivalents define the scope of the invention(s).

What is claimed:

1. A method of blending multiple light channels to produce a preselected illumination spectrum of substantially white light, the method comprising:

providing a common housing with an open top and openings at the bottom, each bottom opening placed over an LED illumination source;

placing a domed lumo converting appliance (DLCA) over each bottom opening and over each LED illumination source;

altering the illumination produced by a first LED illumination source by passing the illumination produced by the first LED illumination source through a first domed lumo converting appliance (DLCA) associated with the common housing to produce a blue channel preselected spectral output;

altering the illumination produced by the second LED illumination source by passing the illumination produced by a second LED illumination source through a second DLCA associated with the common housing to produce a red channel preselected spectral output;

altering the illumination produced by the third LED illumination source by passing the illumination produced by a third LED illumination source through a third DLCA associated with the common housing to produce a yellow/green channel preselected spectral output;

altering the illumination produced by the fourth LED illumination source by passing the illumination produced by a fourth LED illumination source through a fourth DLCA associated with the common housing to produce a cyan channel preselected spectral output;

blending the blue, red, yellow/green, and cyan spectral outputs as the blue, red, yellow/green, and cyan spectral outputs exit the common housing;

wherein the first, second, and third LED illumination sources are blue LEDs and the fourth LED illumination is cyan LEDs;

wherein the blue LEDs have a substantially 440-475 nm output and the cyan LEDs have a substantially 490-515 nm output; wherein each DLCA provides at least one photoluminescent material selected from Phosphors "A", "B", "C", "D", "E", and "F";

wherein:

Phosphor "A" is Cerium doped lutetium aluminum garnet ($Lu_3Al_5O_{12}$) with an emission peak range of 530-540 nm;

Phosphor "B" is Cerium doped yttrium aluminum garnet ($Y_3Al_5O_{12}$) with an emission peak range of 545-555 nm;

Phosphor "C" is Cerium doped yttrium aluminum garnet ($Y_3Al_5O_{12}$) with an emission peak range of 645-655 nm;

Phosphor "D" is GBAM: $BaMgAl_{10}O_{17}$:Eu with an emission peak range of 520-530 nm;

Phosphor "E" is any semiconductor quantum dot material of appropriate size for an emission peak range of 625-635 nm; and, Phosphor "F" is any semiconductor quantum dot material of appropriate size for an emission peak range of 605-615 nm; and wherein one or more of the spectral outputs of the blue, red, green/yellow, and red channels are substantially:

32.8% for wavelengths between 380-420 nm, 100% for wavelengths between 421-460 nm, 66.5% for wavelengths between 461-500 nm, 25.7% for wavelengths between 501-540 nm, 36.6% for wavelengths between 541-580 nm, 39.7% for wavelengths between 581-620 nm, 36.1% for wavelengths between 621-660 nm, 15.5% for wavelengths between 661-700 nm, 5.9% for wavelengths between 701-740 nm and 2.1% for wavelengths between 741-780 nm for the blue channel;

3.9% for wavelengths between 380-420 nm, 6.9% for wavelengths between 421-460 nm, 3.2% for wavelengths between 461-500 nm, 7.9% for wavelengths between 501-540 nm, 14% for wavelengths between 541-580 nm, 55% for wavelengths between 581-620 nm, 100% for wavelengths between 621-660 nm, 61.8% for wavelengths between 661-700 nm, 25.1% for wavelengths between 701-740 nm and 7.7% for wavelengths between 741-780 nm for the red channel;

1% for wavelengths between 380-420 nm, 1.9% for wavelengths between 421-460 nm, 5.9% for wavelengths between 461-500 nm, 67.8% for wavelengths between 501-540 nm, 100% for wavelengths between 541-580 nm, 95% for wavelengths between 581-620 nm, 85.2% for wavelengths between 621-660 nm, 48.1% for wavelengths between 661-700 nm, 18.3% for wavelengths between 701-740 nm and 5.6% for wavelengths between 741-780 nm for the yellow/green channel; or 0.2% for wavelengths between 380-420 nm, 0.8% for wavelengths between 421-460 nm, 49.2% for wavelengths between 461-500 nm, 100% for wavelengths between 501-540 nm, 58.4% for wavelengths between 541-580 nm, 41.6% for wavelengths between 581-620 nm, 28.1% for wavelengths between 621-660 nm, 13.7% for wavelengths between 661-700 nm, 4.5% for wavelengths between 701-740 nm and 1.1% for wavelengths between 741-780 nm for the cyan channel.

2. The method of claim 1 wherein the spectral output of the blue channel is substantially 32.8% for wavelengths between 380-420 nm, 100% for wavelengths between 421-460 nm, 66.5% for wavelengths between 461-500 nm, 25.7% for wavelengths between 501-540 nm, 36.6% for wavelengths between 541-580 nm, 39.7% for wavelengths between 581-620 nm, 36.1% for wavelengths between 621-660 nm, 15.5% for wavelengths between 661-700 nm, 5.9% for wavelengths between 701-740 nm and 2.1% for wavelengths between 741-780 nm.

3. The method of claim 1 wherein the spectral output of the red channel is substantially 3.9% for wavelengths between 380-420 nm, 6.9% for wavelengths between 421-460 nm, 3.2% for wavelengths between 461-500 nm, 7.9% for wavelengths between 501-540 nm, 14% for wavelengths between 541-580 nm, 55% for wavelengths between 581-620 nm, 100% for wavelengths between 621-660 nm, 61.8% for wavelengths between 661-700 nm, 25.1% for wavelengths between 701-740 nm and 7.7% for wavelengths between 741-780 nm.

4. The method of claim 1 wherein the spectral output of the yellow/green channel is substantially 1% for wavelengths between 380-420 nm, 1.9% for wavelengths between 421-460 nm, 5.9% for wavelengths between 461-500 nm, 67.8% for wavelengths between 501-540 nm, 100% for wavelengths between 541-580 nm, 95% for wavelengths between 581-620 nm, 85.2% for wavelengths between 621-660 nm, 48.1% for wavelengths between 661-700 nm, 18.3% for wavelengths between 701-740 nm and 5.6% for wavelengths between 741-780 nm.

5. The method of claim 1 wherein the spectral output of the cyan channel is substantially 0.2% for wavelengths between 380-420 nm, 0.8% for wavelengths between 421-460 nm, 49.2% for wavelengths between 461-500 nm, 100% for wavelengths between 501-540 nm, 58.4% for wavelengths between 541-580 nm, 41.6% for wavelengths between 581-620 nm, 28.1% for wavelengths between 621-660 nm, 13.7% for wavelengths between 661-700 nm, 4.5% for wavelengths between 701-740 nm and 1.1% for wavelengths between 741-780 nm.

6. The method of claim 1 wherein the spectral output of the channels are substantially:

32.8% for wavelengths between 380-420 nm, 100% for wavelengths between 421-460 nm, 66.5% for wavelengths between 461-500 nm, 25.7% for wavelengths between 501-540 nm, 36.6% for wavelengths between 541-580 nm, 39.7% for wavelengths between 581-620 nm, 36.1% for wavelengths between 621-660 nm, 15.5% for wavelengths between 661-700 nm, 5.9% for wavelengths between 701-740 nm and 2.1% for wavelengths between 741-780 nm for the blue channel;

3.9% for wavelengths between 380-420 nm, 6.9% for wavelengths between 421-460 nm, 3.2% for wavelengths between 461-500 nm, 7.9% for wavelengths between 501-540 nm, 14% for wavelengths between 541-580 nm, 55% for wavelengths between 581-620 nm, 100% for wavelengths between 621-660 nm, 61.8% for wavelengths between 661-700 nm, 25.1% for wavelengths between 701-740 nm and 7.7% for wavelengths between 741-780 nm for the red channel;

1% for wavelengths between 380-420 nm, 1.9% for wavelengths between 421-460 nm, 5.9% for wavelengths between 461-500 nm, 67.8% for wavelengths between 501-540 nm, 100% for wavelengths between 541-580 nm, 95% for wavelengths between 581-620 nm, 85.2% for wavelengths between 621-660 nm, 48.1% for wavelengths between 661-700 nm, 18.3% for wavelengths between 701-740 nm and 5.6% for wavelengths between 741-780 nm for the yellow/green channel; and, 0.2% for wavelengths between 380-420 nm, 0.8% for wavelengths between 421-460 nm, 49.2% for wavelengths between 461-500 nm, 100% for wavelengths between 501-540 nm, 58.4% for wavelengths between 541-580 nm, 41.6% for wavelengths between 581-620 nm, 28.1% for wavelengths between 621-660 nm, 13.7% for wavelengths between 661-700 nm, 4.5% for wavelengths between 701-740 nm and 1.1% for wavelengths between 741-780 nm for the cyan channel.

7. The method of claim 1, wherein each of the first, second, third, and fourth DLCAs provides at least one first photoluminescent material selected from Phosphors "A", "B", and "D" and at least one second photoluminescent material selected from Phosphors "C", "E", and "F".

8. A method of blending multiple light channels to produce a preselected illumination spectrum of substantially white light, the method comprising:

providing a common housing having an open top, a plurality of reflective cavities with open bottoms, and each cavity having an open top, each open bottom placed over an LED illumination source;

affixing a substantially planar circular disk lumo converting appliance (LCA) over each cavity's open top;

altering the illumination produced by the first LED illumination source by passing the illumination produced by a first LED illumination source through a first LCA to produce a blue channel preselected spectral output;

altering the illumination produced by the second LED illumination source by passing the illumination produced by a second LED illumination source through a second LCA to produce a red channel preselected spectral output;

altering the illumination produced by the third LED illumination source by passing the illumination produced by a third LED illumination source through a third LCA to produce a yellow/green channel preselected spectral output;

altering the illumination produced by the fourth LED illumination source by passing the illumination produced by a fourth LED illumination source through a fourth LCA to produce a cyan channel preselected spectral output;

blending the blue, red, yellow/green and cyan spectral outputs as the blue, red, yellow/green and cyan spectral outputs exit the common housing;

wherein the first, second, and third LED illumination sources are blue LEDs and the fourth LED illumination is cyan LEDs;

wherein the blue LEDs have a substantially 440-475 nm output and the cyan LEDs have a substantially 490-515 nm output;

wherein each of the first, second, third, and fourth LCAs provides at least one photoluminescent material selected from Phosphors "A", "B", "C", "D", "E", and "F";

wherein:

Phosphor "A" is Cerium doped lutetium aluminum garnet ($Lu_3Al_5O_{12}$) with an emission peak range of 530-540 nm;

Phosphor "B" is Cerium doped yttrium aluminum garnet ($Y_3Al_5O_{12}$) with an emission peak range of 545-555 nm;

Phosphor "C" is Cerium doped yttrium aluminum garnet ($Y_3Al_5O_{12}$) with an emission peak range of 645-655 nm;

Phosphor "D" is GBAM: $BaMgAl_{10}O_{17}$:Eu with an emission peak range of 520-530 nm;

Phosphor "E" is any semiconductor quantum dot material of appropriate size for an emission peak range of 625-635 nm; and, Phosphor "F" is any semiconductor quantum dot material of appropriate size for an emission peak range of 605-615 nm; and wherein one or more of the spectral outputs of the blue, red, green/yellow, and red channels are substantially:

32.8% for wavelengths between 380-420 nm, 100% for wavelengths between 421-460 nm, 66.5% for wavelengths between 461-500 nm, 25.7% for wavelengths between 501-540 nm, 36.6% for wavelengths between 541-580 nm, 39.7% for wavelengths between 581-620 nm, 36.1% for wavelengths between 621-660 nm, 15.5% for wavelengths between 661-700 nm, 5.9% for wavelengths between 701-740 nm and 2.1% for wavelengths between 741-780 nm for the blue channel;

3.9% for wavelengths between 380-420 nm, 6.9% for wavelengths between 421-460 nm, 3.2% for wavelengths between 461-500 nm, 7.9% for wavelengths between 501-540 nm, 14% for wavelengths between 541-580 nm, 55% for wavelengths between 581-620 nm, 100% for wavelengths between 621-660 nm, 61.8% for wavelengths between 661-700 nm, 25.1% for wavelengths between 701-740 nm and 7.7% for wavelengths between 741-780 nm for the red channel;

1% for wavelengths between 380-420 nm, 1.9% for wavelengths between 421-460 nm, 5.9% for wavelengths between 461-500 nm, 67.8% for wavelengths between 501-540 nm, 100% for wavelengths between 541-580 nm, 95% for wavelengths between 581-620 nm, 85.2% for wavelengths between 621-660 nm, 48.1% for wavelengths between 661-700 nm, 18.3% for wavelengths between 701-740 nm and 5.6% for wavelengths between 741-780 nm for the yellow/green channel; or 0.2% for wavelengths between 380-420 nm, 0.8% for wavelengths between 421-460 nm, 49.2% for wavelengths between 461-500 nm, 100% for wavelengths between 501-540 nm, 58.4% for wavelengths between 541-580 nm, 41.6% for wavelengths between 581-620 nm, 28.1% for wavelengths between 621-660 nm, 13.7% for wavelengths between 661-700 nm, 4.5% for wavelengths between 701-740 nm and 1.1% for wavelengths between 741-780 nm for the cyan channel.

9. The method of claim 8 wherein the spectral output of the blue channel is substantially 32.8% for wavelengths between 380-420 nm, 100% for wavelengths between 421-460 nm, 66.5% for wavelengths between 461-500 nm, 25.7% for wavelengths between 501-540 nm, 36.6% for wavelengths between 541-580 nm, 39.7% for wavelengths between 581-620 nm, 36.1% for wavelengths between 621-660 nm, 15.5% for wavelengths between 661-700 nm, 5.9% for wavelengths between 701-740 nm and 2.1% for wavelengths between 741-780 nm.

10. The method of claim 8 wherein the spectral output of the red channel is substantially 3.9% for wavelengths between 380-420 nm, 6.9% for wavelengths between 421-460 nm, 3.2% for wavelengths between 461-500 nm, 7.9% for wavelengths between 501-540 nm, 14% for wavelengths between 541-580 nm, 55% for wavelengths between 581-620 nm, 100% for wavelengths between 621-660 nm, 61.8% for wavelengths between 661-700 nm, 25.1% for wavelengths between 701-740 nm and 7.7% for wavelengths between 741-780 nm.

11. The method of claim 8 wherein the spectral output of the yellow/green channel is substantially 1% for wavelengths between 380-420 nm, 1.9% for wavelengths between 421-460 nm, 5.9% for wavelengths between 461-500 nm, 67.8% for wavelengths between 501-540 nm, 100% for wavelengths between 541-580 nm, 95% for wavelengths between 581-620 nm, 85.2% for wavelengths between 621-660 nm, 48.1% for wavelengths between 661-700 nm, 18.3% for wavelengths between 701-740 nm and 5.6% for wavelengths between 741-780 nm.

12. The method of claim 8 wherein the spectral output of the cyan channel is substantially 0.2% for wavelengths between 380-420 nm, 0.8% for wavelengths between 421-460 nm, 49.2% for wavelengths between 461-500 nm, 100% for wavelengths between 501-540 nm, 58.4% for wavelengths between 541-580 nm, 41.6% for wavelengths between 581-620 nm, 28.1% for wavelengths between 621-660 nm, 13.7% for wavelengths between 661-700 nm, 4.5% for wavelengths between 701-740 nm and 1.1% for wavelengths between 741-780 nm.

13. The method of claim 8 wherein the spectral output of the channels are substantially:

32.8% for wavelengths between 380-420 nm, 100% for wavelengths between 421-460 nm, 66.5% for wavelengths between 461-500 nm, 25.7% for wavelengths between 501-540 nm, 36.6% for wavelengths between 541-580 nm, 39.7% for wavelengths between 581-620 nm, 36.1% for wavelengths between 621-660 nm, 15.5% for wavelengths between 661-700 nm, 5.9% for wavelengths between 701-740 nm and 2.1% for wavelengths between 741-780 nm for the blue channel;

3.9% for wavelengths between 380-420 nm, 6.9% for wavelengths between 421-460 nm, 3.2% for wavelengths between 461-500 nm, 7.9% for wavelengths between 501-540 nm, 14% for wavelengths between 541-580 nm, 55% for wavelengths between 581-620 nm, 100% for wavelengths between 621-660 nm, 61.8% for wavelengths between 661-700 nm, 25.1% for wavelengths between 701-740 nm and 7.7% for wavelengths between 741-780 nm for the red channel;

1% for wavelengths between 380-420 nm, 1.9% for wavelengths between 421-460 nm, 5.9% for wavelengths between 461-500 nm, 67.8% for wavelengths between 501-540 nm, 100% for wavelengths between 541-580 nm, 95% for wavelengths between 581-620 nm, 85.2% for wavelengths between 621-660 nm, 48.1% for wavelengths between 661-700 nm, 18.3% for wavelengths between 701-740 nm and 5.6% for wavelengths between 741-780 nm for the yellow/green channel; and, 0.2% for wavelengths between 380-420 nm, 0.8% for wavelengths between 421-460 nm, 49.2% for wavelengths between 461-500 nm, 100% for wavelengths between 501-540 nm, 58.4% for wavelengths between 541-580 nm, 41.6% for wavelengths between 581-620 nm, 28.1% for wavelengths between 621-660 nm, 13.7% for wavelengths between 661-700 nm, 4.5% for wavelengths between 701-740 nm and 1.1% for wavelengths between 741-780 nm for the cyan channel.

14. The method of claim 8, wherein each of the first, second, third, and fourth LCAs provides at least one first photoluminescent material selected from Phosphors "A", "B", and "D" and at least one second photoluminescent material selected from Phosphors "C", "E", and "F".

* * * * *